United States Patent [19]

Böcker

[11] Patent Number: 4,491,196

[45] Date of Patent: Jan. 1, 1985

[54] TELESCOPIC BEAM

[75] Inventor: Albert Böcker, Werne, Fed. Rep. of Germany

[73] Assignee: Albert Bocker GmbH & Co. KG, Fed. Rep. of Germany

[21] Appl. No.: 420,409

[22] Filed: Sep. 20, 1982

[30] Foreign Application Priority Data

Sep. 23, 1981 [DE] Fed. Rep. of Germany ..... 3137847
Sep. 23, 1981 [DE] Fed. Rep. of Germany ..... 3137845
Sep. 23, 1981 [DE] Fed. Rep. of Germany ..... 3137846

[51] Int. Cl.[3] ..... B66B 9/20

[52] U.S. Cl. ..... 187/10; 182/207; 182/102

[58] Field of Search ..... 187/10, 11, 6, 9 E; 182/194, 207, 209, 210, 211, 213, 101, 102, 103, 126

[56] References Cited

U.S. PATENT DOCUMENTS

| | | | |
|---|---|---|---|
| 470,112 | 3/1892 | Ehrentraut | 187/11 |
| 1,115,721 | 11/1914 | Murdoch | 187/10 |
| 2,987,140 | 6/1961 | Olson | 187/9 E |
| 3,394,778 | 7/1968 | Brinton | 187/9 E |
| 3,451,506 | 6/1969 | Neal | 182/207 |
| 3,693,755 | 9/1972 | Terayama | 182/102 |
| 4,102,433 | 7/1978 | Valkenburgh | 182/207 |

*Primary Examiner*—F. J. Bartuska
*Assistant Examiner*—Kenneth Noland
*Attorney, Agent, or Firm*—George A. Evans, Sr.

[57] ABSTRACT

A telescopic beam for use in an inclined hoist has five telescopic members. An actuator comprising a motorized winch and a block and tackle arrangement is provided for extending the telescopic members relative to one another. The block and tackle arrangement includes a cable which passes several times around sets of rollers positioned at the adjacent ends of first and second of the telescopic members. A lock is provided for fixing the positions of the first and second telescopic members. To relieve the operator of the need for controlling several actuators, the single actuator is used to control the extension of all the telescopic members, and to control the angle of inclination of the last telescopic member relative to the penultimate telescopic member. For this purpose, the cable is passed from the second telescopic member to the far end of the penultimate telescopic member, and then to the adjacent end of the last telescopic member where it is secured.

8 Claims, 9 Drawing Figures

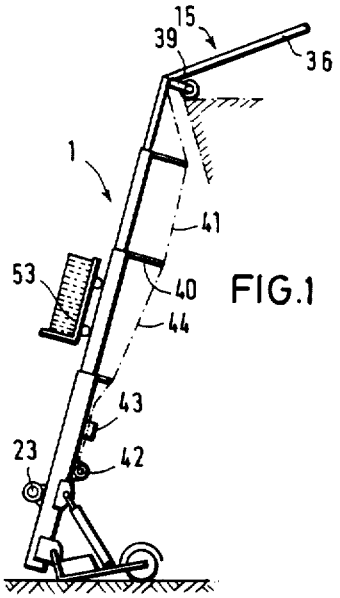
FIG.1
FIG.2
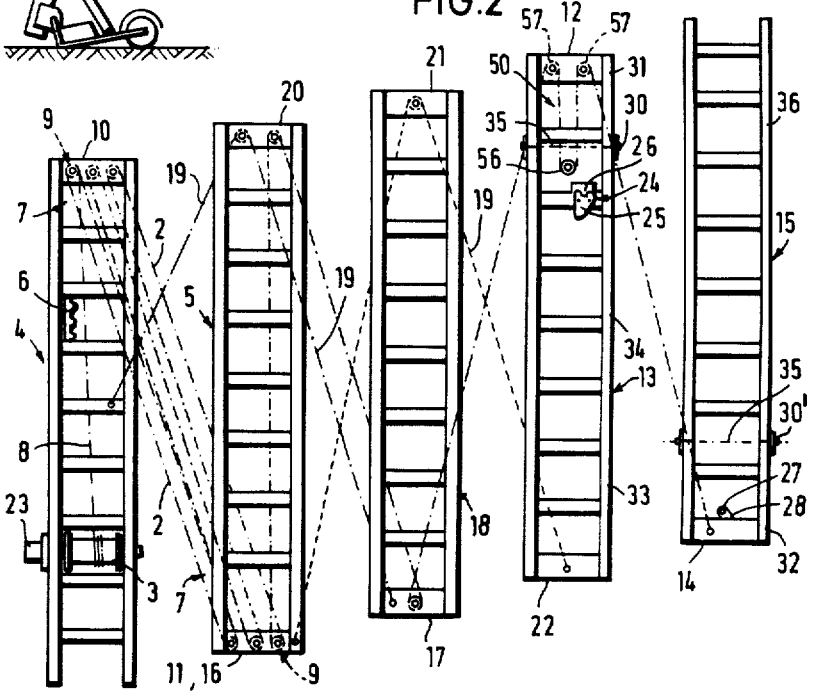

TELESCOPIC BEAM

BACKGROUND TO THE INVENTION

The invention relates to a telescopic beam, particularly for inclined hoisting units and having actuating means, consisting of cable lines, and locking means for securing the first and second telescopic members in the extended position. The actuating means include a block and tackle arrangement having a cable which passes several times around rollers at the adjacent ends of two telescopic members guided one on the other. Telescopic beams, particularly those for inclined hoisting units, are used over fairly great vertical distances in mining for the purpose of conveying the material to the place where it is to be used. As a rule, they are not used for transporting people. One or more motorized winches actuate the cables, with the aid of which the various operations are controlled.

A telescopic beam, particularly for inclined hoisting units and developed by the present Applicant, is known, wherein the conveyor slide at the end of the conveyor beam can be moved into an angled position (DE-OS 27 08 796.3). In this system, however, it is not the last telescopic member that is brought into an angled position, but the conveyor carriage itself.

A telescopic beam, particularly for inclined hoisting units and developed by the present Applicant includes the means for actuating locking elements arranged between the first and second telescopic members can be actuated from a fixed point by way of swivellable elements, which in turn actuate the locking cams or the like, these swivellable elements serving to guide one or more cables which can be reduced in length. (see DE-OS 0030 01 410)

The swivellable elements with their associated locking elements can be co-ordinated with the second and following telescopic members and throughout as far as the penultimate telescopic member.

These known forms of construction have proved reliable in principle, but during the course of rationalization and in efforts to simplify and reduce the cost of the operating equipment, the tendency has been to render the inclined hoisting unit itself as light as possible and to carry out the greatest possible number of operations by means of one cable, so that work is made easier for the operator who, hitherto, has often been called upon to operate several winches in unison.

SUMMARY OF THE INVENTION

The invention is intended to provide a technical advance in this respect. The invention, as characterized in the claims, solves the problem of redesigning a telescopic beam, particularly for use in an inclined hoist units, in such a way that, by means of only one cable and only one motorized winch provided for this cable, all of the telescopic members as far as the last can be locked in any required extended positions and, furthermore, the last telescopic member can be extended and moved into any required angular position.

The main advantages achieved by the invention are that use is made of only one winch instead of several winches that only one block and tackle cable is used, that the locking of all the telescopic members following the second is achieved by means of cables of fixed length which do not have to be manipulated, and that the same cable as is used for extending all the telescopic members between the second and the penultimate telescopic member also extends and angles the last telescopic member, it being possible for all of the manipulations to be carried out by way of the motorized winch.

BRIEF DESCRIPTION OF THE DRAWINGS

In the drawings:

FIG. 1 is a simplified side elevation of an inclined hoist compressing telescopic beams, FIG. 2 shows the five telescopic members forming the telescopic beam, the telescopic members being disposed side by side in the drawing, so as to show the cable guide system more clearly.

DESCRIPTION OF PREFERRED EMBODIMENT

Figure 3:
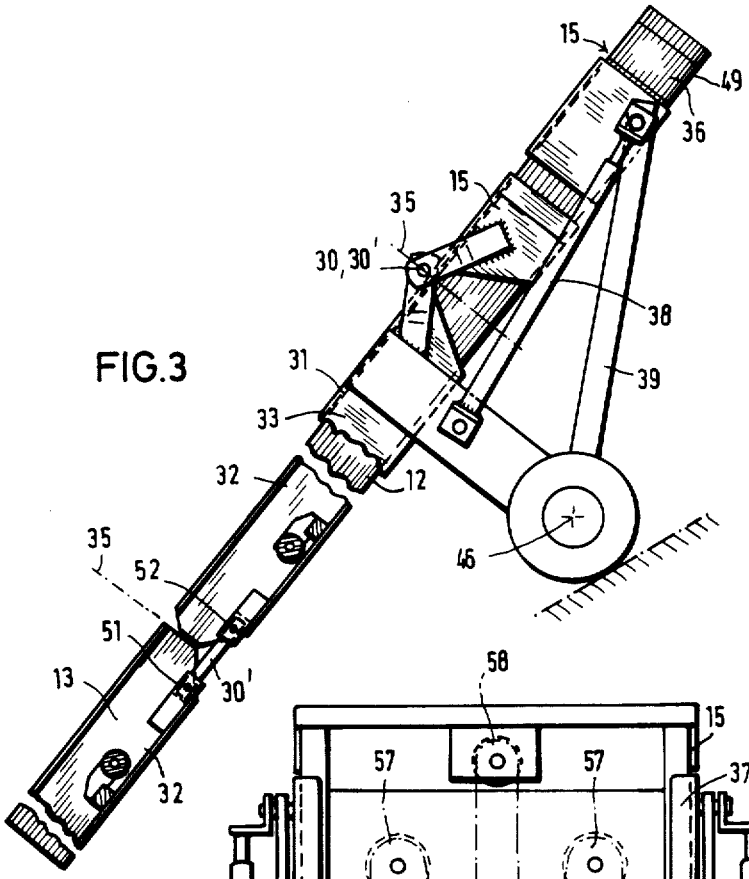
FIG. 3 is a side view, partly in section, showing one end of the telescopic beam whose last telescopic member is deflected.

The first telescopic member 4 of the inclined hoisting unit 1 carries an actuating means 3 in the form of a motorized winch 23, the cable line 2 of which is a cable 8 of a tackle arrangement 7. The cable 8 passes several times around rollers mounted at the upper end 10 of the first member 4 and the lower end 16 of the second telescopic member 5.

Provided between the first telescopic member 4 and the second telescopic member 5 is a manually operable locking means 6 which is brought into engagement when a predetermined or preselected extension length is reached and which therefore prevents relative displacement of these two telescopic members.

In principle, the cable 8 could be led from the commencement 16 of the second telescopic member 5, over the penultimate telescopic member 13, and directed to the commencement 14 of the last telescopic member 15. However, in order to avoid damage to the cable, it is expedient, in the manner illustrated, to lead the cable 8 first from the lower end of the second telescopic member 5 to the outer end 20 thereof, and from there to the lower end 17 of the third telescopic member 18 it is then led to the multiple sheave 50 at the outer end 12 of the fourth or penultimate telescopic member 13. The multiple sheave 50 has a pair of rollers 57 and a lower roller 56 and to the cable 8 passes around one of the outer rollers 57, thence to the swivellable median roller 56 and then back again to the other outer roller 57 and finally to the lower end 14 of the last telescopic member 15. Here the cable 8 is secured at 45 (see FIGS. 3, 4 and 5).

It is obvious that effective uniform extension cannot be achieved with the cable 8 only. Incremental extension, dependent upon the friction conditions, would occur, and relative displacement of the telescopic members would still occur following operation of the lock 8. A locking action is therefore usually required between the individual pairs of telescopic members. In accordance with the invention, this is achieved with the help of fixed length cables 19 which are led respectively from the first telescopic member 4 over a pulley at the upper end 20 of the second telescopic member 5 and terminating at the lower end 17 of the third telescopic member 18 and from lower end 16 of the second telescopic member 5 over the pulley at the outer end 21 of the third telescopic member 18 to the lower end 22 of the or fourth telescopic member 13. These cable portions 19 do not require to be operated. They function automatically. Only the length of the legs alters. If the position between the first telescopic member 4 and the second telescopic member 5 changes, the position between each pair of following members also changes accordingly. Thus, the problem of effecting locking between these telescopic members is solved.

Figure 4:
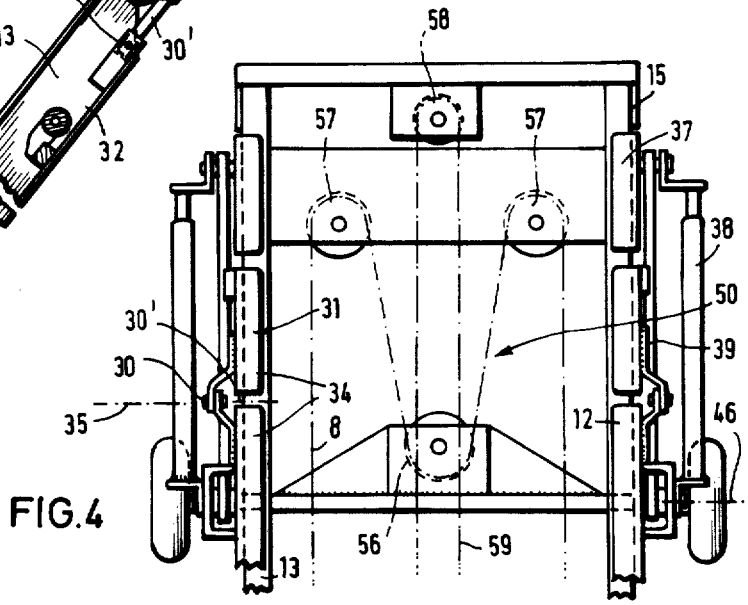
FIG. 4 is a plan view of the beam end illustrated in FIG. 3.
Figure 5:
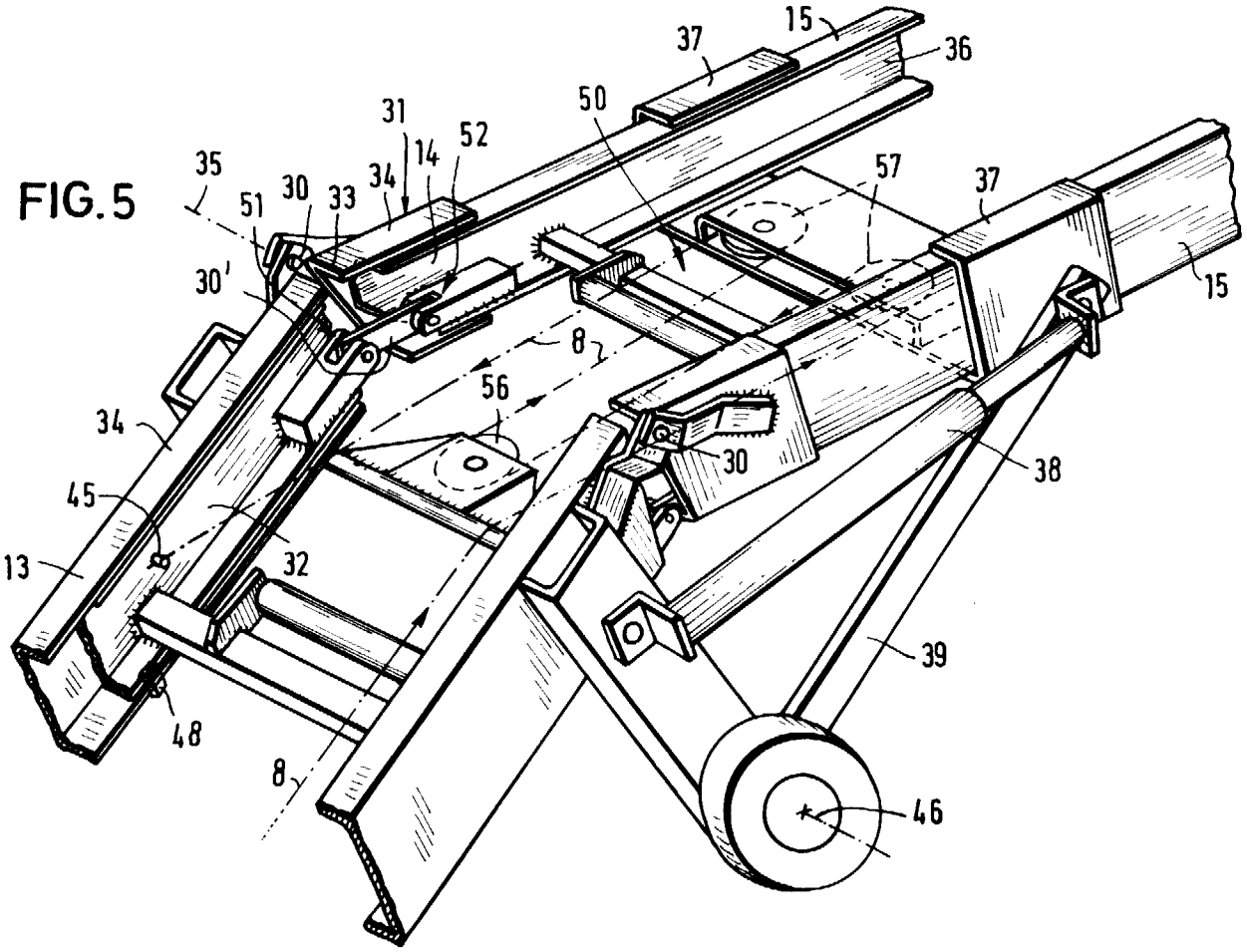
FIG. 5 is a perspective view of the last telescopic members, with the last telescopic member deflected of the beam
Figure 6:
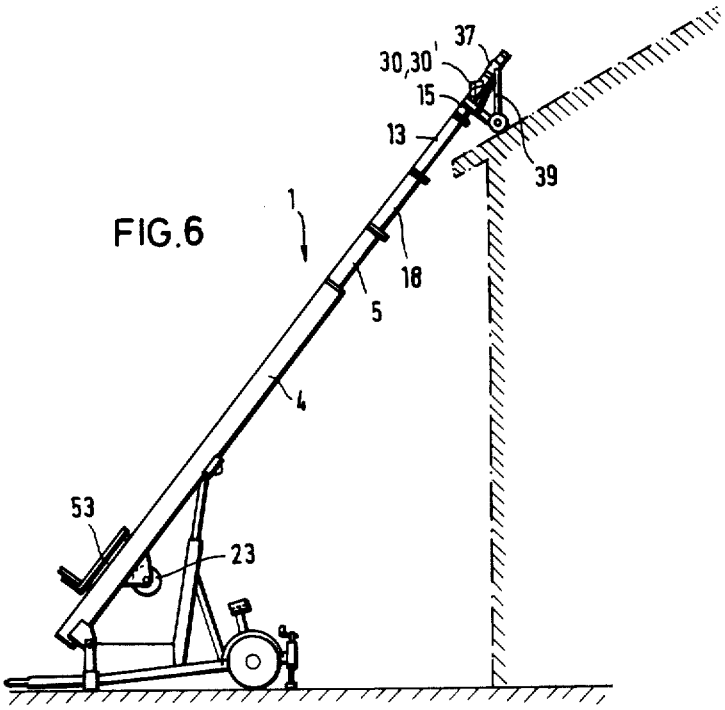
FIGS. 6, 7 and 8 are side elevations of the inclined hoisting unit in three different operating positions.
Figure 7:
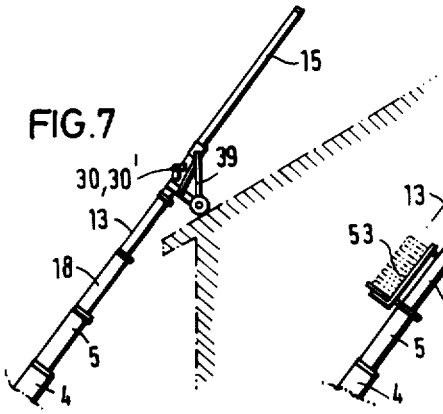
Figure 9:
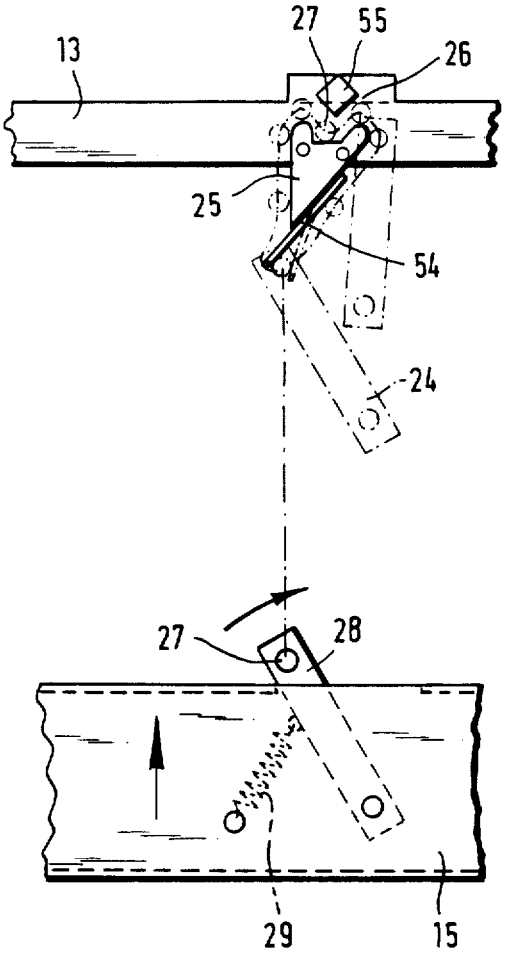
FIG. 9 is a schematic view and shows the construction of an automatic snap-in locking device.

If the last telescopic member 15 is to be deflectable in the extended position, then it must be in guiding connection with the penultimate telescopic member 13 and, it has to be of a particular shape. As shown in FIGS. 3, 4 and 5, the fourth or penultimate telescopic member 13 has a guide member 31, at its upper end 12, a guide member 31 being pivotally connected to said end by pins 30, the guide member 31 has a guide provided with flanges 34 which embrace the corresponding profile of the last telescopic member 15. The last telescopic member 15 carries a corresponding guide member 32, which is pivotally connected by hinges 51 and 52 and pins 30 at its commencement 14. The locking device 24 (see FIG. 9) is so arranged that, in the locking position, the hinges 51 and 52 with the pins 30 and 30' lie approximately at the same level and are therefore released.

Extension of the beam and the function of the deflection of the last telescopic member 15 are as follows:

By means of the cable 8, the required length of beam, minus the last telescopic member 15, is paid out, and the locking means 6 is engaged. Each telescopic member except the last member 15 will then have travelled the same distance relative to the member on which it is guided. The forces are absorbed by the cables 19 of fixed length. The cable 8 is then relieved of load. If the motorized winch 23 is then actuated again, the cable 8 can be reduced in length by pulling the last telescopic member 15 out of the guide provided by the fourth or penultimate telescopic member 13. This is because the cable 8 is fixed, at 45, to the lower end 14 of the member 15.

The last telescopic member 15 then runs into a suitable stop, not shown, which is so arranged that the interfaces 35 of the two hinges 51 and 52 are located in the same position (see FIG. 5) and the hinges are therefore released. As soon as the operator releases the tension of the cable 8 in the zone of the multiple sheave 50, thereby tensioning the deflected portion, the last telescopic member 15, driven by its own weight, swings, portion 31 and the hinge 32, the required working position. As it swings the last telescopic member 15 carries the engaged guide members 31 and 32.

Thus, with the help of the motorized winch 23 and only one control cable (the cable 8), three operations can be carried out:

first: extension of the second, third and fourth telescopic members 5, 18 and 13 respectively.

second: extension of the last telescopic member 15.

third: deflection of the last telescopic member 15 into the working position.

With the aid of the cable 8 and the multiple sheave 50, the deflection can be cancelled. Thus, as the cable 8 is tensioned, so that a guide arm 38, pivotable about the wheel axle 46, pivots a slide shoe 37, which is fixed to the upper end portion 36 of the last telescopic member 15, so that the latter is again brought into a position in which it is aligned with the penultimate telescopic member 13. The slide shoe 37 carries the pulleys 37 so that tensioning of the cable 8 causes the last telescopic member 15 to be further extended over a short distance owing to the action of the multiple sheave 50, so that the locking pin 27 (see FIG. 9) of a lever 28, which is biassed by a spring 29, is moved out of the lock catch 26 and is swung about the heart-shaped guide member 25. This releases the lock between members 13 and 15. A blocking member 55 enables this operation to be carried out in a more reliable manner. The last telescopic member 15 can then be moved into the penultimate member 13, and the locking pin 27 returned to its initial position to lock members 13 and 15 together. As the pin 27 returns to its initial position, it deflects a leaf spring 54.

Figure 8:
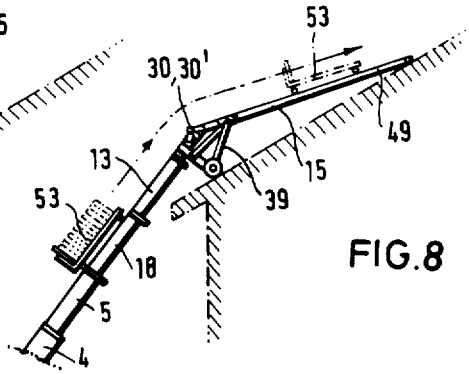

The carriage 53 is moved, in the known manner, into its end position illustrated in FIG. 8, with the aid of an additional cable 59, which is led over a load roller 58 (see FIG. 4) arranged at the end of the last telescopic member 15.

A further arrangement is illustrated in FIG. 1. By the use of a tensioning cable 44 as a lower chord 41, the bending strength of the telescopic beam can be increased to such extent that it undergoes virtually no appreciable deflection by its own weight and the load (carriage 53) moving along it. The various telescopic members can therefore be moved more easily relatively to each other, the entire construction is lighter, and the load weight can be increased. The arrangement includes a tensioning cable 44 which runs from a tensioned supply drum 42, by way of retractable spacing members 40, to the penultimate telescopic member 13. The cable 44 defines a tensioned lowered chord 41, and can be secured to the beam.

The tensioning supply drum 42 automatically pulls in the tensioning cable 44 when the length of the telescopic beam is reduced. The locking means 6 and the fixed length cables 19 facilitate this operation.

The deflection caused by the weight of the beam and the carriage 53, after the last telescopic member 15 with its outer portion 36 has been laid on a fixed point, results in tensioning of the cable 44. Special tensioning devices are not required.

I claim:

1. A telescopic beam for use as an inclined hoist, the telescopic beam comprising a plurality of telescopic members each having first and second ends, the telescopic beam having actuating means for moving the telescopic members relative to one another, and locking means for securing first and second of the telescopic members in the extended position, the actuating means including a block and tackle arrangement having a cable which passes several times around two sets of rollers positioned respectively at the second end of the first telescopic member and at the first end of the second telescopic member, the telescopic member remote from the first being hinged to the adjacent telescopic member so that the angular position of the remote telescopic member relative to said adjacent telescopic member can be fixed, wherein the adjacent ends of the remote telescopic member and said adjacent telescopic member are provided with respective guide members, each guide member being pivotally connected to its associated telescopic member by a pivot pin and being in engagement with the other telescopic member, and wherein a locking device is provided for locking the remote telescopic member at any predetermined angle to said adjacent telescopic member, the guide member of said adjacent telescopic member having a guide body provided with flanges which lie on opposite sides of the remote telescopic member, and the pivot pin of the guide member of said adjacent telescopic member being located outside the guide body and being arranged approximately in the plane of one of said flanges at the interface with the other guide member.

2. A telescopic beam according to claim 1, wherein the adjacent ends of the remote telescopic member and said adjacent telescopic member are interconnected by an additional connecting arrangement having a slide shoe which embraces the end of the remote telescopic member, the slide shoe being connected by a guide arm to a support beam, which is in turn firmly secured to the end of said adjacent telescopic member.

3. A telescopic beam for use as an inclined hoist, the telescopic beam comprising first, second, third, fourth and fifth telescopic members each having first and second ends, the telescopic beam having actuating means for moving the telescopic members relative to one another, and locking means for securing the first and second telescopic members in the extended position, the actuating means including a block and tackle arrangement having a cable which passes several times around two sets of rollers positioned respectively at the second end of the first telescopic member and at the first end of the second telescopic member, wherein the cable runs from the second telescopic member to the second end of the fourth telescopic member and then to the first end of the fifth telescopic member where it is secured, wherein a second cable runs from the first telescopic member around a pulley at the second end of the second telescopic member to the first end of the third telescopic member, and a third cable runs from the first end of the second telescopic member around a pulley at the second end of the third telescopic member to the first end of the fourth telescopic member, the second and third cables each having a fixed length, and wherein the portion of the first-mentioned cable between the second telescopic member and the fifth telescopic member is relieved of tension by the second and third cables when the first telescopic member and the second telescopic member are unlocked and extended, and the fifth telescopic member is extended relative to the fourth telescopic member only after the locking means has been actuated upon renewed operation of the actuating means.

4. A telescopic beam according to claim 3, wherein the first-mentioned cable runs from the first end of the second telescopic member to the second end thereof, from there to the first end of the third telescopic member, and from there to the second end of the fourth telescopic member.

5. A telescopic beam according to claim 3, wherein the locking means can be actuated from a control position, and the position of the second, third and fourth members can be indirectly fixed by the second and third cables.

6. A telescopic beam according to claim 3, wherein the actuating means includes a motorized winch in drivable connection with the first-mentioned cable.

7. A telescopic beam for use as an inclined hoist, the telescopic beam comprising first, second, third, fourth and fifth telescopic members each having first and second ends, the telescopic beam having actuating means for moving the telescopic members relative to one another, and locking means for securing the first and second telescopic members in the extended position, the actuating means including a block and tackle arrangement having a cable which passes several times around two sets of rollers positioned respectively at the second end of the first telescopic member and at the first end of the second telescopic member, wherein the cable runs from the second telescopic member to the second end of the fourth telescopic member and then to the first end of the fifth telescopic member where it is secured, wherein a locking device is provided for locking the fourth and fifth telescopic members together, the locking device being adapted to snap in automatically when the fifth telescopic member has been extended by a predetermined distance relative to the fourth telescopic member to prevent further retraction of the fifth telescopic member, and wherein the locking device comprises a generally heart-shaped guide member having a lock catch associated with one of said telescopic members, and a resiliently pivotable locking bolt on a lever associated with the other of said telescopic members, the locking bolt bearing on the guide member during extension of the fifth telescopic member relative to the fourth telescopic member until it falls into the locking catch when the next retraction movement occurs, the locking catch and the guide member being of such dimensions that, upon renewed relative movement of said telescopic members caused by tensioning the first mentioned cable, the locking bolt lifts from the locking catch, pivots to a further extent and then, with the subsequent change in direction of movement of said telescopic members, swings round and into the guide member and drops back into its original position.

8. A telescopic beam according to claim 7, wherein the actuating means includes a motorized winch in drivable connection with the first-mentioned cable.

* * * * *